US008393617B2

(12) United States Patent
Wang et al.

(10) Patent No.: US 8,393,617 B2
(45) Date of Patent: Mar. 12, 2013

(54) SHEET ALIGNMENT DEVICE

(75) Inventors: Ching-Tse Wang, Taipei (TW); Chia-Wen Wu, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 0 days.

(21) Appl. No.: 13/233,385

(22) Filed: Sep. 15, 2011

(65) Prior Publication Data

US 2012/0299239 A1 Nov. 29, 2012

(30) Foreign Application Priority Data

May 27, 2011 (TW) ..... 10118601 A

(51) Int. Cl.
*B65H 33/08* (2006.01)

(52) U.S. Cl. ..... 271/222; 271/221; 271/220; 271/223

(58) Field of Classification Search ..... 271/207, 271/220–223

See application file for complete search history.

(56) References Cited

U.S. PATENT DOCUMENTS 6,231,039 B1 * 5/2001 Chung ..... 270/58.01
6,832,759 B2 * 12/2004 Nagasako et al. ..... 271/222
6,871,851 B2 * 3/2005 Tamura et al. ..... 271/221
6,942,206 B2 * 9/2005 Kuwata et al. ..... 270/58.08
7,530,566 B2 * 5/2009 Terao et al. ..... 271/207
7,607,651 B2 * 10/2009 Kuwata et al. ..... 270/58.11
7,748,704 B2 * 7/2010 Terao et al. ..... 271/207
7,753,368 B2 * 7/2010 Sekiyama et al. ..... 271/207
7,832,725 B2 * 11/2010 Hosoya et al. ..... 271/213
7,874,558 B2 * 1/2011 Ogata et al. ..... 271/221
7,954,808 B2 * 6/2011 Tomida ..... 271/207
2009/0026696 A1 * 1/2009 Ogata et al. ..... 271/220
2011/0024973 A1 * 2/2011 Sekiyama et al. ..... 271/185
2011/0215523 A1 * 9/2011 Tsuji et al. ..... 271/226

* cited by examiner

*Primary Examiner* — Kaitlin Joerger
(74) *Attorney, Agent, or Firm* — Kirton McConkie; Evan R. Witt

(57) ABSTRACT

A sheet alignment device includes a first alignment arm, a second alignment arm, a first sensor and a controller. The first alignment arm includes a first blocking piece and a second blocking piece. During the sheet-aligning action of each sheet, the first alignment arm is moved for a preset distance from a standby position. Then, the first alignment arm is moved back to the standby position, and a waiting time is required to introduce a next sheet into the sheet placement tray. When the first sensor is no longer interrupted by the second blocking piece of the first alignment arm, the controller starts to calculate the moving distance of the first alignment arm. Since the moving distance of the first alignment arm is calculated at the same start point during the sheet-aligning action of each sheet is performed, the possibility of resulting in the moving distance error is minimized.

9 Claims, 13 Drawing Sheets

SHEET ALIGNMENT DEVICE

FIELD OF THE INVENTION

The present invention relates to a sheet alignment device, and more particularly to a sheet alignment device for use in an office machine.

BACKGROUND OF THE INVENTION

An office machine such as a printer or a scanner is widely used in the office. For achieving diversified functions and integrating more functions, the office machine is usually equipped with a post-processing device (e.g. a stapler). By the stapler, a plurality of documents outputted from the printer or the scanner can be automatically stapled in order to enhance the working efficiency. The operations of the post-processing device (e.g. a stapler) will be illustrated as follows. Firstly, the documents are placed on a sheet placement tray. Then, the edges of these documents are aligned with each other by a sheet alignment device. Then, a stapling operation is performed by the stapler, so that the same parts of these documents are combined together.

Please refer to FIGS. 1A and 1B. FIG. 1A is a schematic planar view illustrating a conventional sheet alignment device. FIG. 1B is a schematic cross-sectional view illustrating the conventional sheet alignment device. The conventional sheet alignment device as shown in FIGS. 1A and 1B is disclosed in for example U.S. Pat. No. 7,134,659.

The sheet alignment device 1 comprises a first alignment arm 11, a second alignment arm 12, a sensor 13 and a sheet placement tray 14. The first alignment arm 11 comprises a first platform 11*a*, a first sidewall 11*b* and a protrusion structure 11*c*. The second alignment arm 12 comprises a second platform 12*a* and a second sidewall 12*b*.

The first sidewall 11*b* of the first alignment arm 11 is extended from an end of the first platform 11*a* and perpendicular to the first platform 11*a*. The protrusion structure 11*c* is extended from the first sidewall 11*b*. The second sidewall 12*b* of the second alignment arm 12 is extended from an end of the second platform 12*a* and perpendicular to the second platform 12*a*. The sensor 13 is arranged beside the protrusion structure 11*c*. The sheet placement tray 14 is disposed under the first alignment arm 11 and the second alignment arm 12. Moreover, the first platform 11*a* of the first alignment arm 11 and the second platform 12*a* of the second alignment arm 12 are coplanar.

Hereinafter, the operations of the conventional sheet alignment device 1 will be illustrated with reference to FIGS. 1A and 1B. In a case that no sheet is introduced to the sheet alignment device 1, the first alignment arm 11 and the second alignment arm 12 are respectively located at a first home positional and a second home position a2. Meanwhile, the sensor 13 is interrupted by the protrusion structure 11*c* of the first alignment arm 11, and thus a first sensing signal is issued by the sensor 13.

After the sheet is introduced into the sheet alignment device 1, the power device (not shown) is controlled by a controller (not shown) to drive both of the first alignment arm 11 and the second alignment arm 12 to be inwardly moved by a preset distance d1. Consequently, the first alignment arm 11 and the second alignment arm 12 are moved to a first standby position b1 and a second standby position b2 so as to carry the sheet S. Meanwhile, the protrusion structure 11*c* of the first alignment arm 11 is distant from the sensor 13, and thus a second sensing signal is issued by the sensor 13.

When the sheet-aligning action starts, according to the size of the sheet S and under control of the controller (not shown), the first alignment arm 11 is moved toward the second alignment arm 12 by an alignment distance d2 to an alignment position c. Meanwhile, the edge of the sheet S is nestled against the second sidewall 12*b*.

If another sheet is ready to be introduced into the sheet alignment device 1, the power device (not shown) is controlled by the controller (not shown) to drive the first alignment arm 11 to be distant from the second alignment arm 12 by the alignment distance d2. Consequently, the first alignment arm 11 is returned to the first standby position b1. Similarly, the first alignment arm 11 is moved between the first standby position b1 and the alignment position c in a reciprocating manner until the rest of the sheets implement the sheet-aligning actions.

After the sheet-aligning actions of all sheets have been implemented, a stapling operation is performed by a post-processing device (e.g. a stapler), so that the same parts of these sheets are combined together. Then, the power device (not shown) is controlled by the controller (not shown) to drive both of the first alignment arm 11 and the second alignment arm 12 to be outwardly moved until the sensor 13 is interrupted by the protrusion structure 11*c* of the first alignment arm 11 again and the first sensing signal is issued by the sensor 13. That is, the first alignment arm 11 and the second alignment arm 12 are respectively returned to the first home position a1 and the second home position a2. Afterwards, the stapled sheets are introduced to the sheet placement tray 14 and ejected to the outer portion of the office machine.

From the above discussions, a plurality of sheets are aligned with each other by moving the first alignment arm 11 and the second alignment arm 12 of the conventional sheet alignment device 1. In addition, the use of the sensor 13 can detect the positions of the first alignment arm 11 and the second alignment arm 12.

The conventional sheet alignment device, however, still has some drawbacks. For example, during the process of performing the sheet-aligning actions of the sheets, the power device (not shown) drives the first alignment arm 11 to be moved between the first standby position b1 and the alignment position c in a reciprocating manner. In addition, the sensor 13 is only able to detect whether the first alignment arm 11 and the second alignment arm 12 are respectively located at the first home position a1 and the second home position a2. On the other hand, the sensor 13 fails to judge whether the first alignment arm 11 is really moved to the first standby position b1. If the first alignment arm 11 is moved by a distance shorter than the alignment distance d2 after the sheet-aligning action of the first sheet is completed, the first alignment arm 11 fails to be moved to the actual first standby position b1. Under this circumstance, the real position of the first alignment arm 11 is separated from the first standby position b1 by an error distance. After the sheet-aligning action of the second sheet is completed, the edges of the second sheet and the first sheet are separated from each other by the error distance. In other words, the second sheet fails to be precisely aligned with the first sheet. If the error distance is generated again during the subsequent sheet-aligning actions are performed, the total error distances will be largely increased. After the sheet-aligning actions of all sheets have been implemented and the sheets are combined together, the stapled parts of these sheets are not at the same position.

Therefore, there is a need of providing an improved sheet alignment device so as to obviate the drawbacks encountered from the prior art.

SUMMARY OF THE INVENTION

The present invention relates to a sheet alignment device with reduced moving distance error, and thus the sheet-aligning precision is enhanced.

In accordance with an aspect of the present invention, there is provided a sheet alignment device for aligning a plurality of sheets on a sheet placement tray with each other. The sheet alignment device includes a first alignment arm, a second alignment arm, a power device, a transmission device, a first sensor and a second sensor. The first alignment arm is used for carrying first ends of the sheets. The first alignment arm includes a first platform, a first sidewall, a first blocking piece and a second blocking piece. The first platform is parallel with the sheet placement tray. The first sidewall is perpendicular to the first platform. The first blocking piece and the second blocking piece are disposed over the first platform. The second alignment arm is used for carrying second ends of the sheets. The second alignment arm includes a second platform, a second sidewall and a third blocking piece. The second platform is parallel with the sheet placement tray. The second sidewall is perpendicular to the second platform, and the third blocking piece is disposed over the second platform. The transmission device is connected with the power device, the first alignment arm and the second alignment arm. Through the transmission device, the first alignment arm is driven by the power device to be moved to a first home position, a first standby position and an alignment position, and the second alignment arm is driven by the power device to be moved to a second home position and a second standby position. The first sensor is disposed over the first alignment arm for detecting a position of the first alignment arm. The second sensor is disposed over the second alignment arm for detecting a position of the second alignment arm.

In an embodiment, the power device includes a first driving element and a second driving element. The transmission device comprises a first transmission element and a second transmission element. The first transmission element is connected with the first driving element and the first alignment arm. The second transmission element is connected with the second driving element and the second alignment arm.

In an embodiment, the first alignment arm further includes a third platform, and the second alignment arm further includes a fourth platform. The third platform is extended from the first sidewall and parallel with the first platform. The fourth platform is extended from the second sidewall and parallel with the second platform.

In an embodiment, the sheet alignment device includes a first roller, a second roller and a first elastic element. The first roller is disposed on the first driving element. The second roller is disposed on the third platform of the first alignment arm. The outer peripheries of the first roller and the second roller are enclosed by the first transmission element. The first elastic element is disposed on the first transmission element for maintaining a tension force of the first transmission element In an embodiment, the sheet alignment device further includes a third roller, a fourth roller and a second elastic element. The third roller is disposed on the second driving element. The fourth roller is disposed on the fourth platform of the second alignment arm. The outer peripheries of the third roller and the fourth roller are enclosed by the second transmission element. The second elastic element is disposed on the second transmission element for maintaining a tension force of the second transmission element.

In an embodiment, the first blocking piece and the second blocking piece are disposed on the third platform. The third blocking piece is disposed on the fourth platform.

In an embodiment, the sheet alignment device further includes a supporting shaft. Both ends of the supporting shafts are disposed on the third platform and the fourth platform to be connected with the first alignment arm and the second alignment arm, respectively. The first alignment arm and the second alignment arm are movable toward each other or distant from each other along the supporting shaft.

In an embodiment, the first alignment arm further includes a first fixing part, and the second alignment arm further includes a second fixing part. The first fixing part is disposed on the third platform for fixing the first alignment arm on the first transmission element. The second fixing part is disposed on the fourth platform for fixing the second alignment arm on the second transmission element.

In an embodiment, the sheet alignment device further includes a controller for controlling movement of the first alignment arm and the second alignment arm. If no sheet is placed on the sheet placement tray, the first alignment arm and the second alignment arm are controlled by the controller to be moved to the first home position and the second home position. If the first sensor and the second sensor are respectively interrupted by the first blocking piece and the third blocking piece, the controller stops moving the first alignment arm and the second alignment arm.

In an embodiment, when a first sheet is introduced into the sheet placement tray, the first alignment arm and the second alignment arm are controlled by the controller to be moved to the first standby position and the second standby position, respectively. Whereas, when the first sensor is interrupted by the second blocking piece, the controller stops moving the first alignment arm and the second alignment arm.

In an embodiment, when a sheet-aligning action of the first sheet starts, the first alignment arm is controlled by the controller to be moved to the alignment position according to a size of the first sheet. After the sheet-aligning action of the first sheet is completed, if there is any sheet to be aligned, the first alignment arm is moved to the first standby position. When the first sensor is interrupted by the second blocking piece, the controller stops moving the first alignment arm.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a sheet alignment device. The sheet alignment device may be applied to an office machine.

Figure 1A:
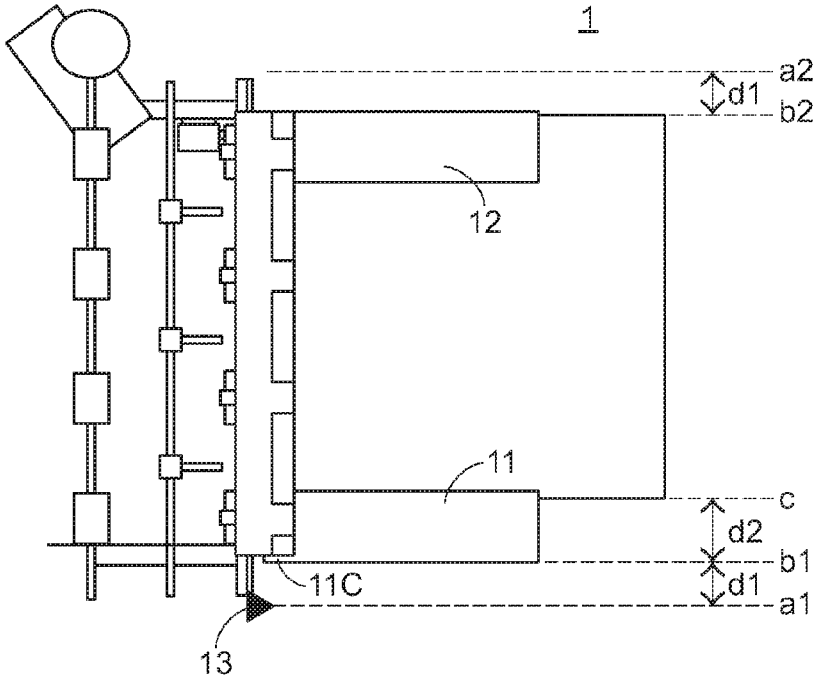
FIG.1A PRIOR ART
FIG. 1A is a schematic planar view illustrating a conventional sheet alignment device.
Figure 1B:
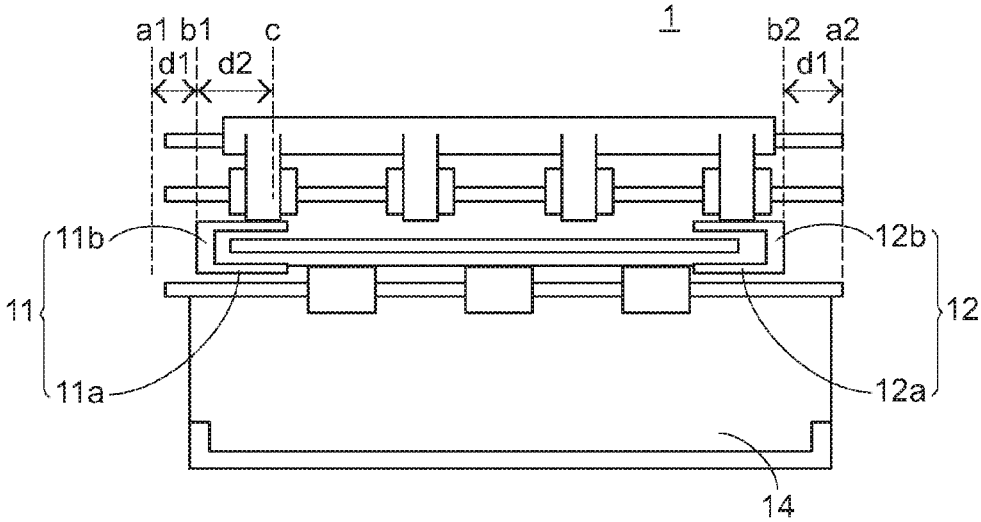
FIG.1B PRIOR ART
FIG. 1B is a schematic cross-sectional view illustrating the conventional sheet alignment device.
Figure 2:
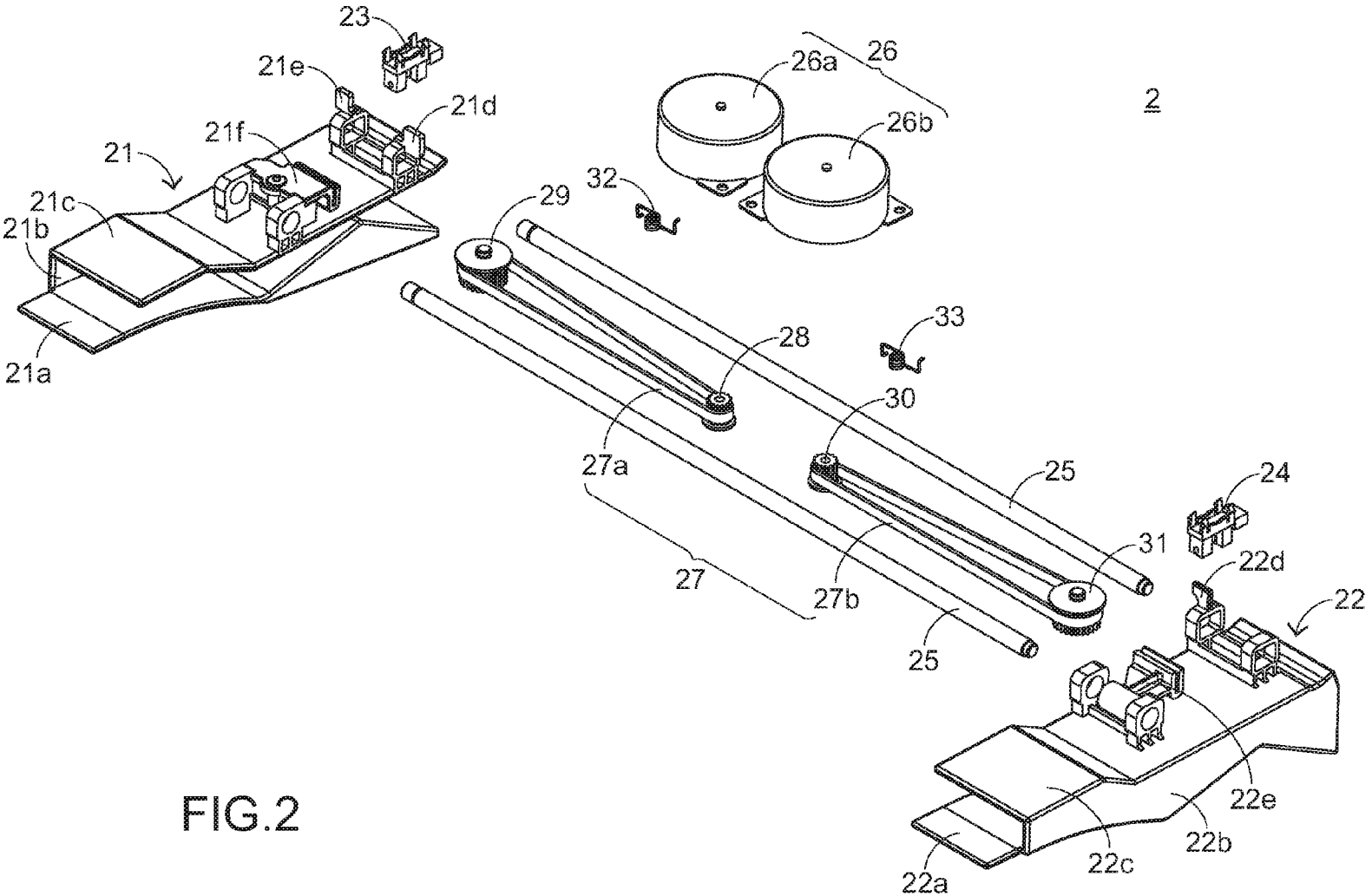
FIG. 2 is a schematic exploded view illustrating a sheet alignment device according to an embodiment of the present invention.

FIG. 2 is a schematic exploded view illustrating a sheet alignment device according to an embodiment of the present invention. As shown in FIG. 2, the sheet alignment device 2 comprises a first alignment arm 21, a second alignment arm 22, a first sensor 23, a second sensor 24, two supporting shafts 25, a power device 26, a transmission device 27, a first roller 28, a second roller 29, a third roller 30, a fourth roller 31, a first elastic element 32, a second elastic element 33 and a controller 34 (see FIG. 5).

The first alignment arm 21 comprises a first platform 21*a*, a first sidewall 21*b*, a third platform 21*c*, a first blocking piece 21*d*, a second blocking piece 21*e* and a first fixing part 21*f*. The second alignment arm 22 comprises a second platform 22*a*, a second sidewall 22*b*, a fourth platform 22*c*, a third blocking piece 22*d* and a second fixing part 22*e*. The power device 26 comprises a first driving element 26*a* and a second driving element 26*b*. The transmission device 27 comprises a first transmission element 27*a* and a second transmission element 27*b*.

Figure 3:
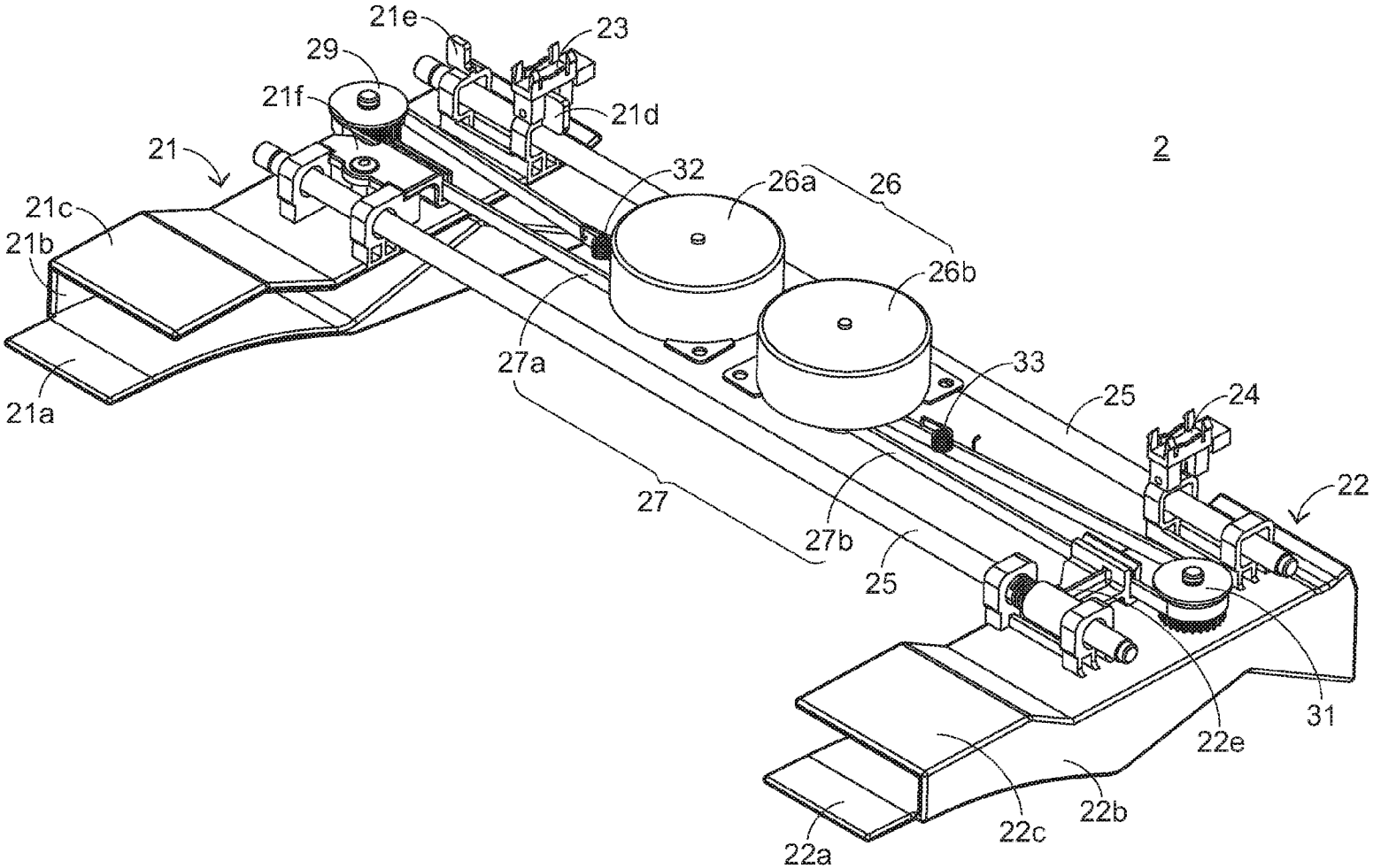
FIG. 3 is a schematic assembled view illustrating the sheet alignment device according to the embodiment of the present invention.

Hereinafter, a process of assembling the sheet alignment device will be illustrated with reference to FIGS. 2 and 3. FIG. 3 is a schematic assembled view illustrating the sheet alignment device according to the embodiment of the present invention. The first sidewall 21*b* of the first alignment arm 21 is extended from an end of the first platform 21*a* and perpendicular to the first alignment arm 21. The third platform 21*c* is extended from a top edge of the first sidewall 21*b* and parallel with the first platform 21*a*. The first blocking piece 21*d*, the second blocking piece 21*e* and the first fixing part 21*f* are disposed on the third platform 21*c*. The second sidewall 22*b* of the second alignment arm 22 is extended from the second platform 22*a* and perpendicular to the second platform 22*a*. The fourth platform 22*c* is extended from the second sidewall 22*b* and parallel with the second platform 22*a*. The third blocking piece 22*d* and the second fixing part 22*e* are disposed on the fourth platform 22*c*. The first sensor 23 is disposed over the third platform 21*c* of the first alignment arm 21. The second sensor 24 is disposed over the fourth platform 22*c* of the second alignment arm 22. The two supporting shafts 25 are parallel with each other. The both ends of each supporting shaft 25 are respectively penetrated through the top surfaces of the third platform 21*c* and the fourth platform 22*c*, so that the both ends of each supporting shaft 25 are connected with the first alignment arm 21 and the second alignment arm 22. Moreover, as the first alignment arm 21 and the second alignment arm 22 are horizontally moved along the two supporting shafts 25, the first alignment arm 21 and the second alignment arm 22 are moved toward each other or distant from each other. The first driving element 26*a* and the second driving element 26*b* of the power device 26 are arranged between the first alignment arm 21 and the second alignment arm 22. The first roller 28 is disposed under the first driving element 26*a*. The second roller 29 is disposed on the third platform 21*c* of the first alignment arm 21. The outer peripheries of the first roller 28 and the second roller 29 are enclosed by the first transmission element 27*a* of the transmission device 27. In addition, the first transmission element 27*a* is fixed on the first fixing part 21*f* of the first alignment arm 21 for connecting the first driving element 26*a* with the first alignment arm 21. The first elastic element 32 is disposed on the first transmission element 27*a* for maintaining the tension force of the first transmission element 27*a*. The third roller 30 is disposed under the second driving element 26*b*. The fourth roller 31 is disposed on the fourth platform 22*c* of the second alignment arm 22. The third roller 30 and the fourth roller 31 are enclosed by the second transmission element 27*b* of the transmission device 27. In addition, the second transmission element 27*b* is fixed on the second fixing part 22*e* of the second alignment arm 22 for connecting the second driving element 26*b* with the second alignment arm 22. The second elastic element 33 is disposed on the second transmission element 27*b* for maintaining the tension force of the second transmission element 27*b*.

Figure 4:
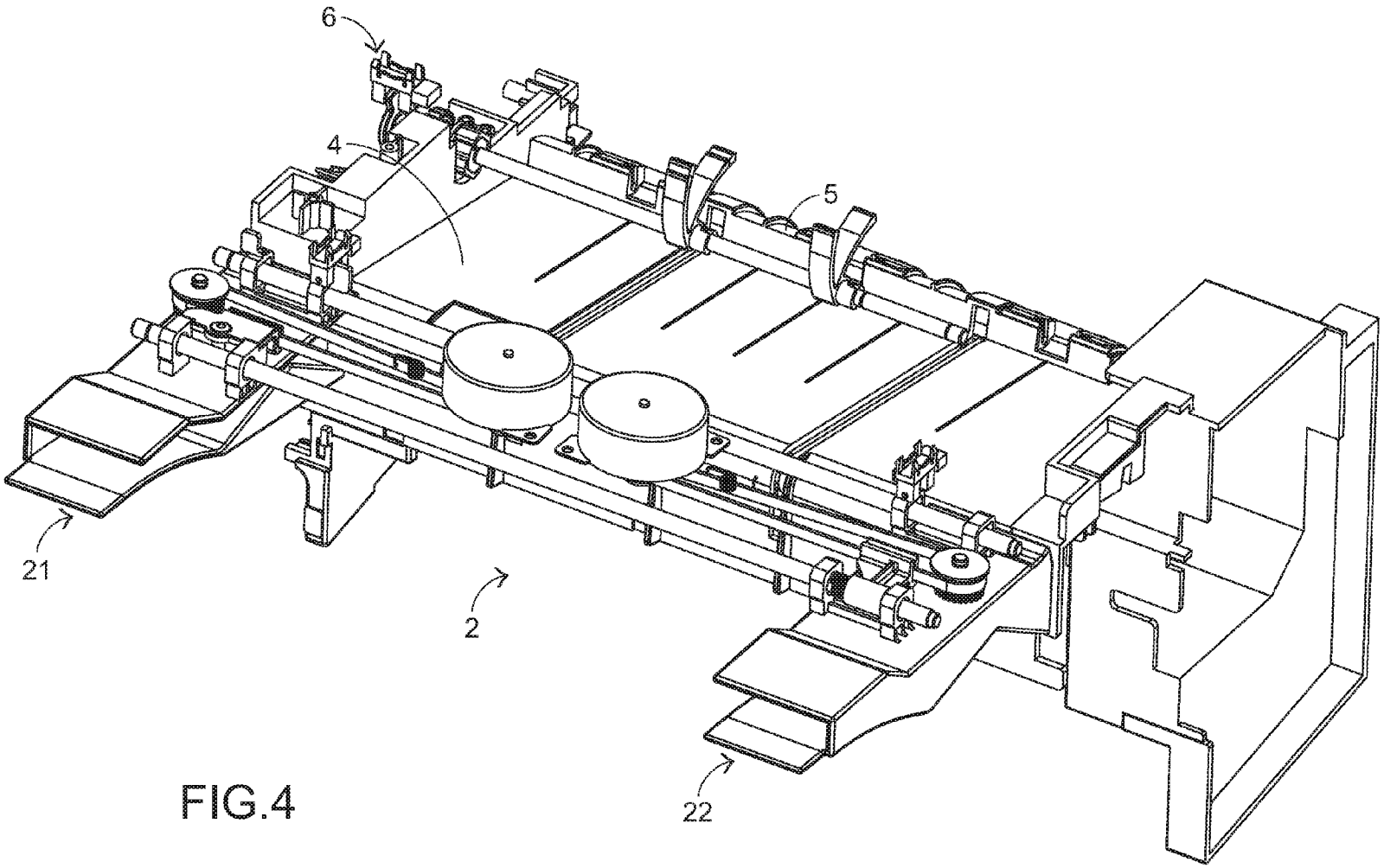
FIG. 4 is a schematic perspective view illustrating the sheet alignment device applied to an office machine according to an embodiment of the present invention.

Hereinafter, the operating principle of the present invention will be illustrated with reference to FIG. 4. FIG. 4 is a schematic perspective view illustrating the sheet alignment device applied to an office machine according to an embodiment of the present invention. As shown in FIG. 4, the first alignment arm 21 and the second alignment arm 22 of the sheet alignment device 2 are respectively located at bilateral sides of the rear end of the sheet placement tray 4. In addition, the first alignment arm 21 and the second alignment arm 22 are parallel with the sheet placement tray 4. Please refer to FIG. 4. Firstly, a plurality of sheets printed by the office machine (e.g. a printer) are outputted and introduced to the sheet placement tray 4 through a sheet advancing path 5. Then, by a short side alignment device 6, the short sides of these sheets are nestled against a front end of the sheet placement tray 4. Then, by the first alignment arm 21 and the second alignment arm 22 of the sheet alignment device 2, the long sides of these sheets are aligned with each other. Then, a stapling operation is performed by a post-processing device (e.g. a stapler), so that the same parts of these sheets are combined together. Afterwards, the stapled sheets are ejected from the sheet placement tray 4 to the outer portion of the office machine.

Figure 5:
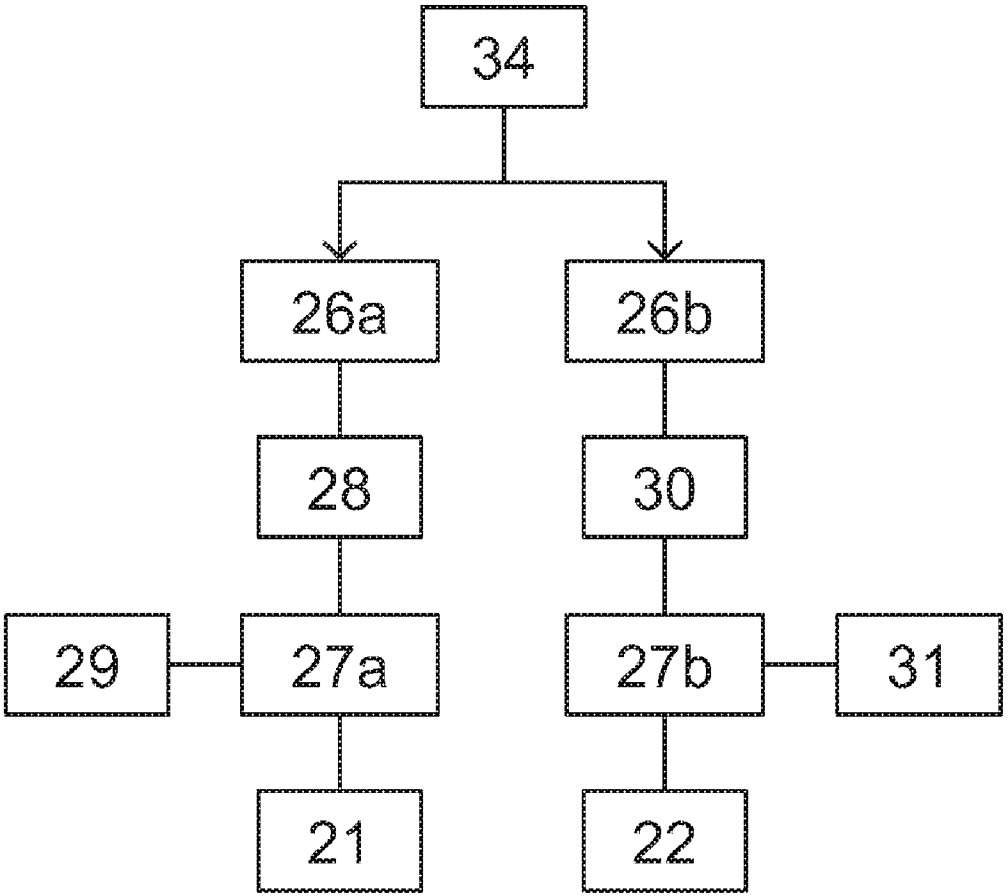
FIG. 5 is a schematic block diagram illustrating a sheet alignment device according to an embodiment of the present invention.

Hereinafter, the operations of the sheet alignment device 2 will be illustrated with reference to FIG. 5. FIG. 5 is a schematic block diagram illustrating a sheet alignment device according to an embodiment of the present invention. The sheet alignment device comprises a controller 34 for controlling the operations of the sheet alignment device 2. As shown in FIG. 5, the rotations of the first driving element 26*a* and the second driving element 26*b* of the power device 26 are controlled by the controller 34. As the first driving element 26*a* is rotated, the first roller 28 is synchronously rotated to drive the first transmission element 27*a* of the transmission device 27. At the same time, the second roller 29 is driven by the first transmission element 27*a* to rotate, so that the first transmission element 27*a* is moved more smoothly. Under this circumstance, since the first alignment arm 21 is connected with the first transmission element 27*a*, the first alignment arm 21 is simultaneously moved with the first transmission element 27*a*.

As the second driving element 26*b* is rotated, the third roller 30 is synchronously rotated to drive the second transmission element 27*b* of the transmission device 27. At the same time, the fourth roller 31 is driven by the second transmission element 27*b* to rotate, so that the second transmission element 27*b* is moved more smoothly. Under this circumstance, since the second alignment arm 22 is connected with the second transmission element 27*b*, the second alignment arm 22 is simultaneously moved with the second transmission element 27*b*.

Figure 6A:
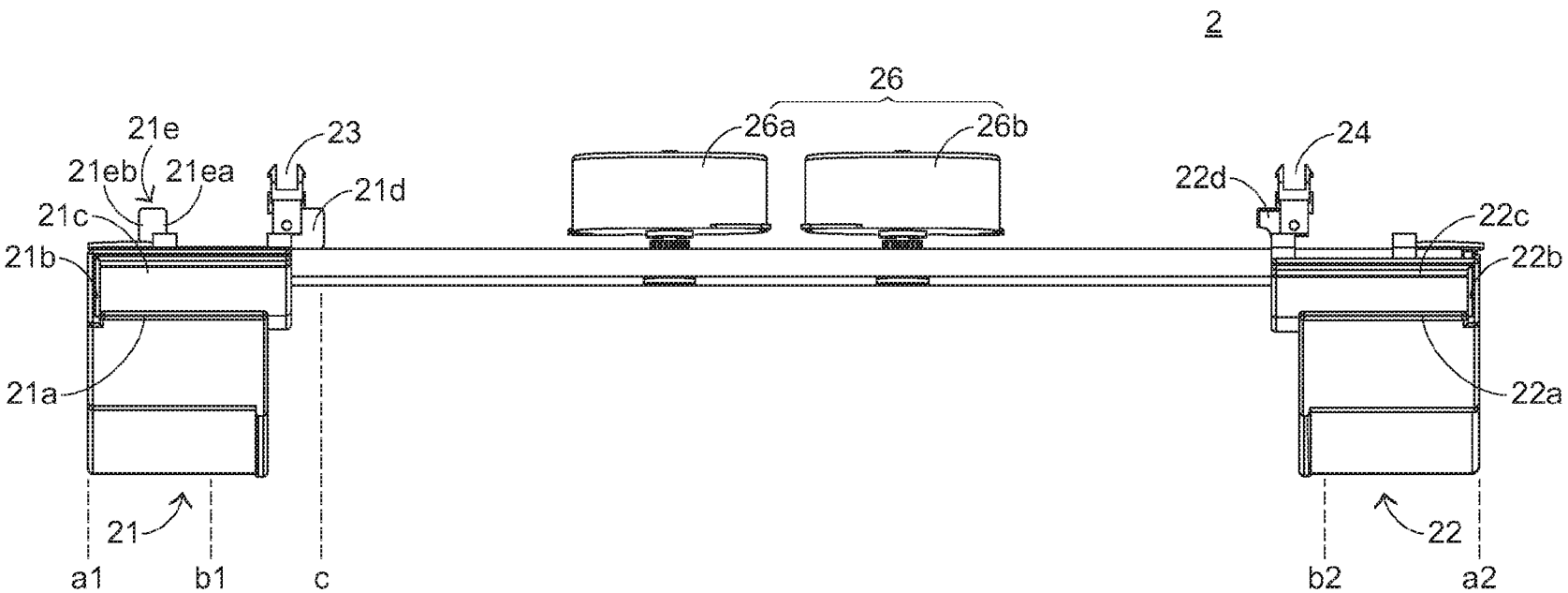
FIG. 6A is a schematic side view illustrating a sheet alignment device according to an embodiment of the present invention, in which the first alignment arm and the second alignment arm are respectively located at a first home position and a second home position.
Figure 6B:
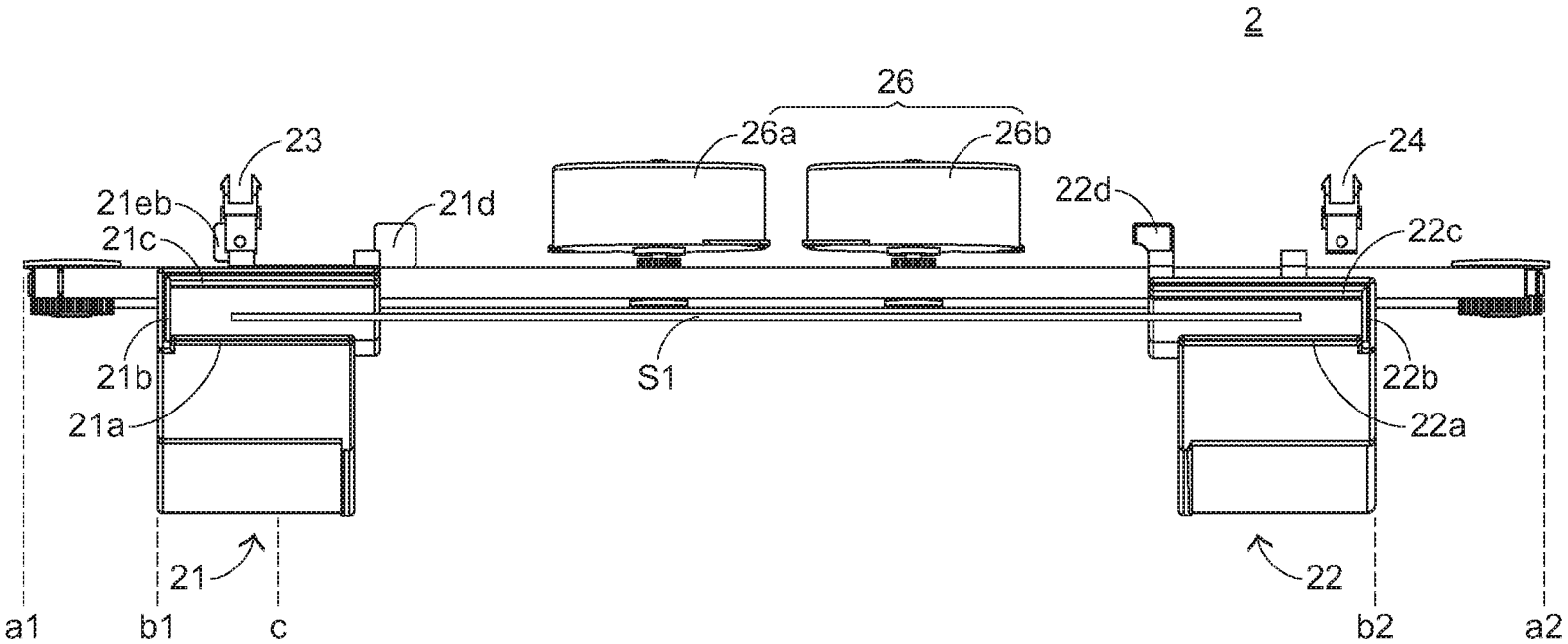
FIG. 6B is a schematic side view illustrating a sheet alignment device according to an embodiment of the present invention, in which the first alignment arm and the second alignment arm are respectively located at a first standby position and a second standby position.
Figure 6C:
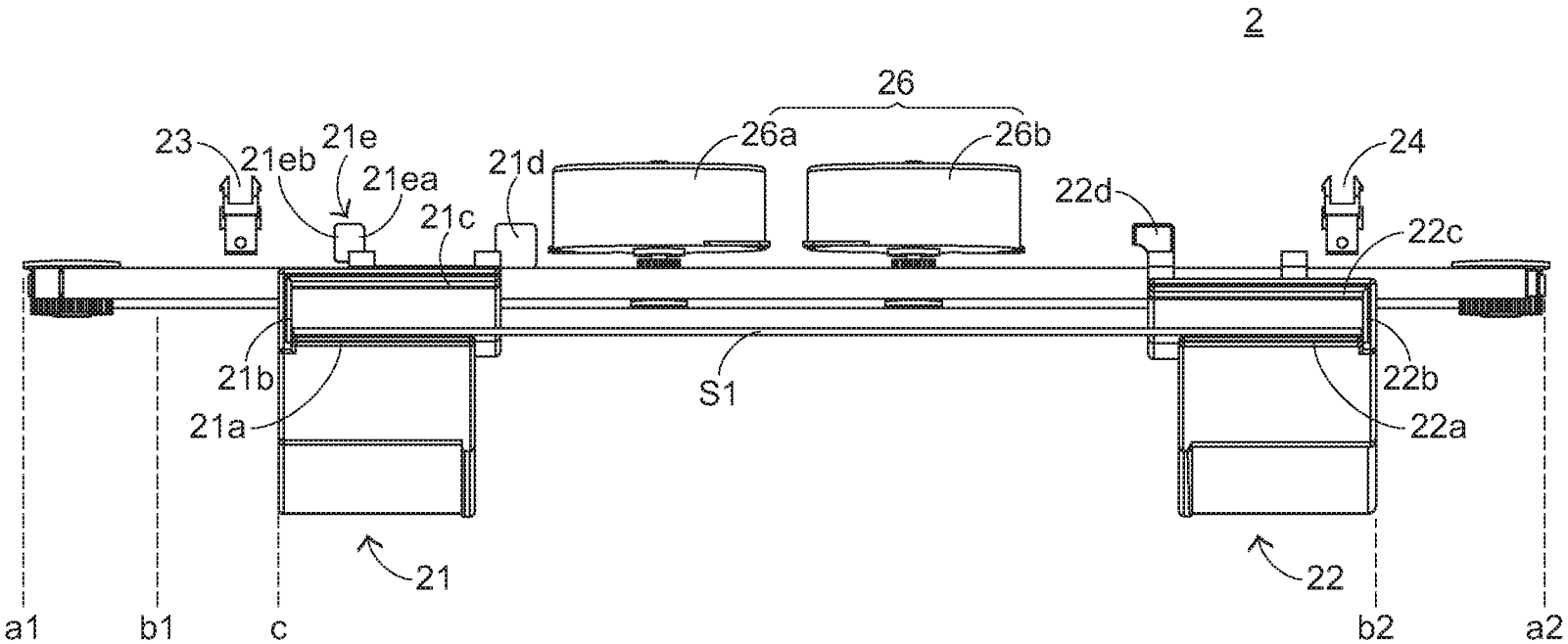
FIG. 6C is a schematic side view illustrating a sheet alignment device according to an embodiment of the present invention, in which the first alignment arm is located at a sheet alignment position.
Figure 6D:
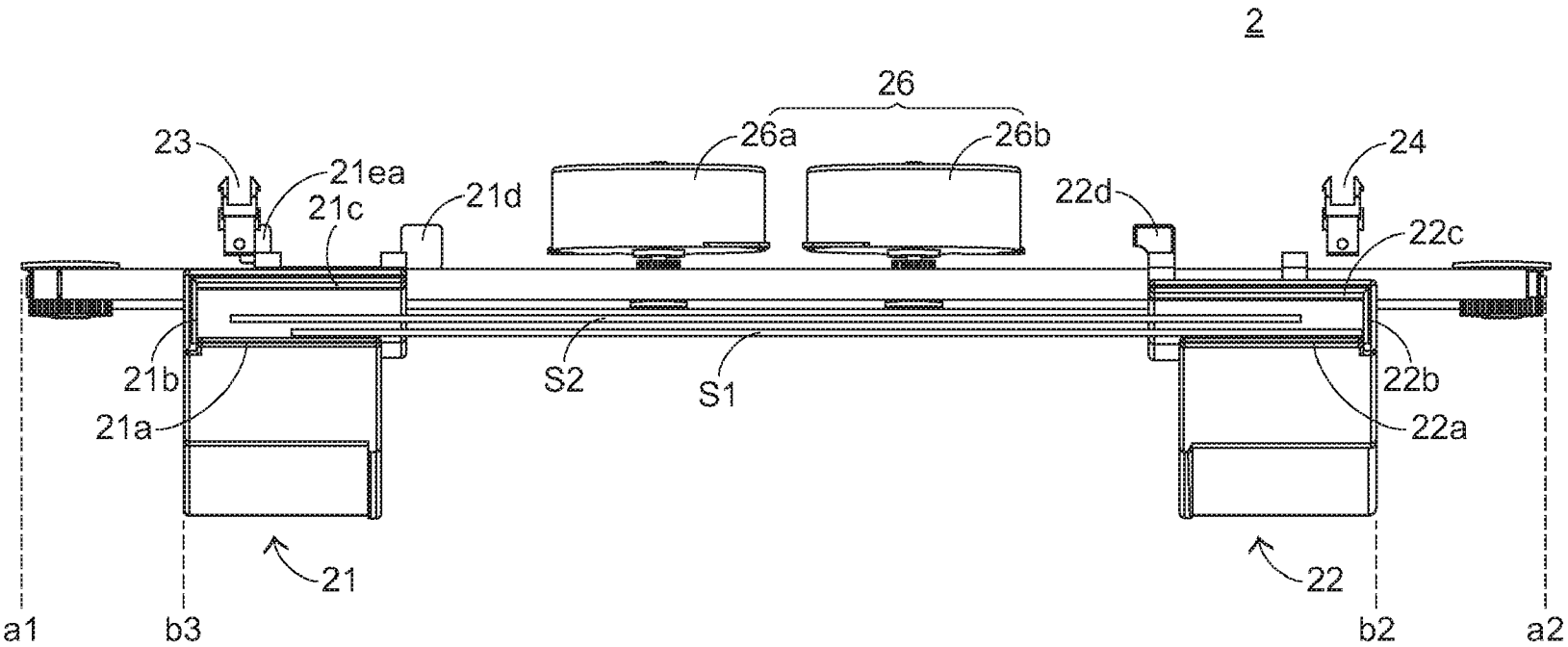
FIG. 6D is a schematic side view illustrating a sheet alignment device according to an embodiment of the present invention, in which a second sheet is introduced into the sheet placement tray.
Figure 6E:
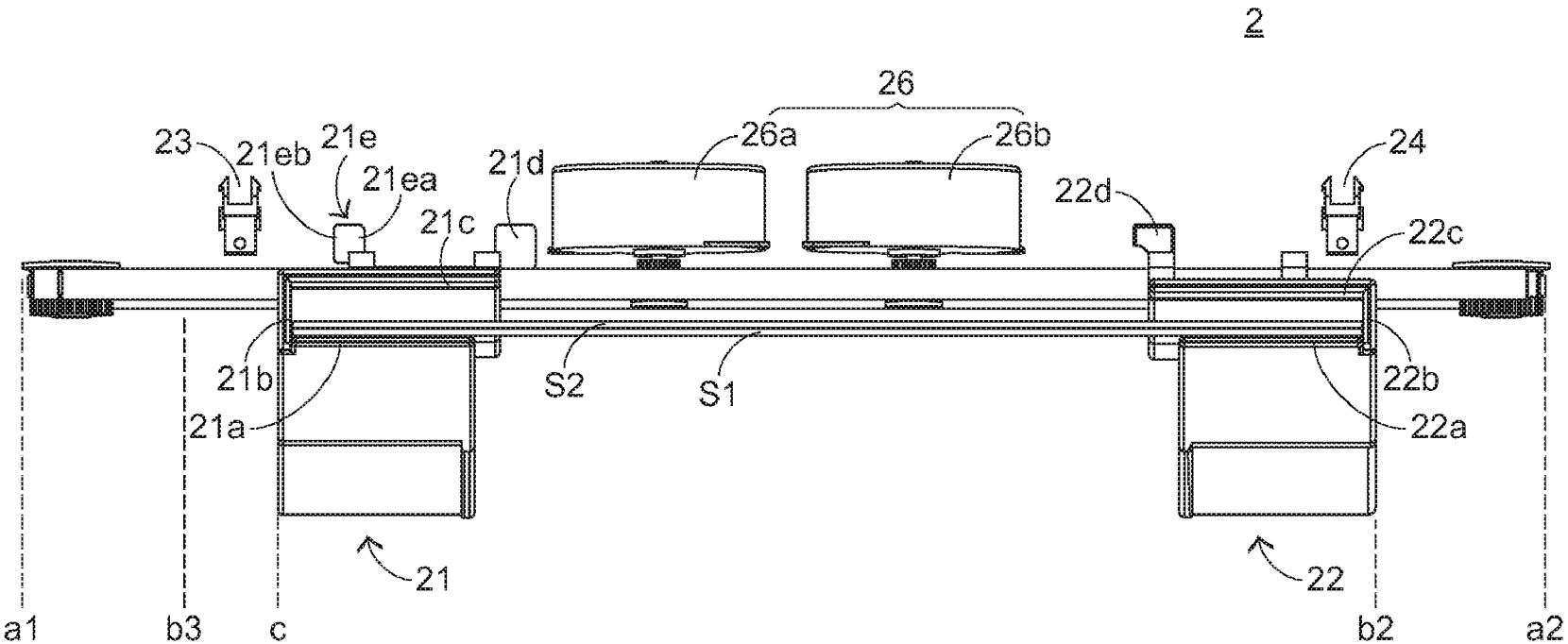
FIG. 6E is a schematic side view illustrating a sheet alignment device according to an embodiment of the present invention, in which the sheet-aligning actions of a first sheet and a second sheet are completed.
Figure 7:
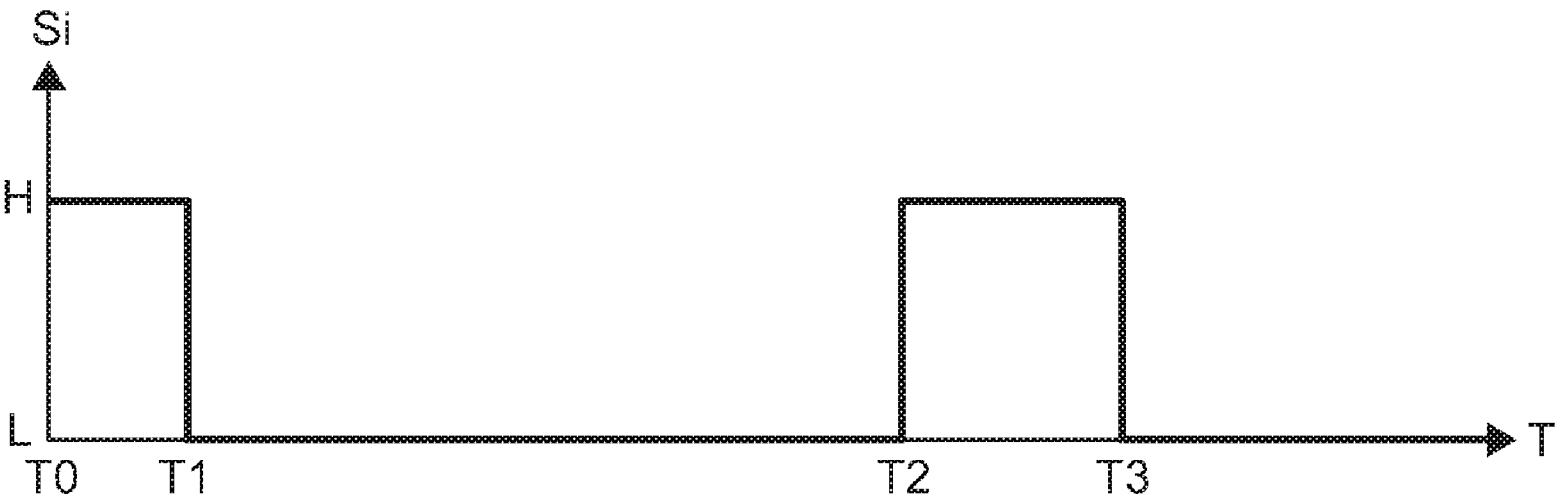
FIG. 7 is a schematic timing waveform diagram illustrating an output signal from a first sensor of a sheet alignment device according to an embodiment of the present invention.

Please refer to FIGS. 6A-6E and FIG. 7. FIG. 6A is a schematic side view illustrating a sheet alignment device according to an embodiment of the present invention, in which the first alignment arm and the second alignment arm are respectively located at a first home position and a second home position. FIG. 6B is a schematic side view illustrating a sheet alignment device according to an embodiment of the present invention, in which the first alignment arm and the second alignment arm are respectively located at a first standby position and a second standby position. FIG. 6C is a schematic side view illustrating a sheet alignment device according to an embodiment of the present invention, in which the first alignment arm is located at a sheet alignment position. FIG. 6D is a schematic side view illustrating a sheet alignment device according to an embodiment of the present invention, in which a second sheet is introduced into the sheet placement tray. FIG. 6E is a schematic side view illustrating a sheet alignment device according to an embodiment of the present invention, in which the sheet-aligning actions of a first sheet and a second sheet are completed. FIG. 7 is a schematic timing waveform diagram illustrating an output signal from a first sensor of a sheet alignment device according to an embodiment of the present invention. The X axis denotes the time T. The Y axis denotes the output signal Si issued by the first sensor 23.

In a case that no sheet is introduced to the sheet placement tray 4, the first alignment arm 21 and the second alignment arm 22 are respectively located at a first home position a1 and a second home position a2 (see FIG. 6A). Meanwhile, the first sensor 23 is interrupted by the first blocking piece 21*d* of the first alignment arm 21, and thus the first sensor 23 issues a high-level signal H. As shown in FIG. 7, the high-level signal H is generated at the time spot T0. At the same time, the second sensor 22*d* is interrupted by the third blocking piece 22*d*.

Please also refer to FIG. 3. When a first sheet S1 is ready to be introduced to the sheet placement tray 4, the first driving element 26*a* is controlled by the controller 34 to be rotated in an anti-clockwise direction, and thus the first transmission element 27*a* is driven to be rotated in the anti-clockwise direction. At the same time, the second driving element 26*b* of the power device 26 is controlled by the controller 34 to be rotated in a clockwise direction. Correspondingly, the second transmission element 27*b* of the transmission device 27 is rotated in the clockwise direction. As the first transmission element 27*a* is rotated in the anti-clockwise direction, the first alignment arm 21 is moved toward the second alignment arm 22. Similarly, as the second transmission element 27*b* is rotated in the clockwise direction, the second alignment arm 22 is moved toward the first alignment arm 21. After the first alignment arm 21 has moved for a certain time period, the first sensor 23 is no longer interrupted by the first blocking piece 21*d* of the first alignment arm 21, and thus the first sensor 23 issues a low-level signal L. As shown in FIG. 7, the low-level signal L is generated at the time spot T1. When the first alignment arm 21 is moved to a position where the first sensor 23 is interrupted by the first end 21*ea* of the second blocking piece 21*e*, the first sensor 23 issues the high-level signal H again. As shown in FIG. 7, the high-level signal H is generated at the time spot T2. According to the repeated interrupted status of the first sensor 23, the controller 34 will stop driving the first driving element 26*a* and the second driving element 26*b*. Under this circumstance, the first alignment arm 21 and the second alignment arm 22 are no longer moved. As shown in FIG. 6B, the first alignment arm 21 is located at a first standby position b1 to carry an side of the first sheet S1, and the second alignment arm is located at a second standby position b2 to carry another side of the first sheet S1.

Please also refer to FIG. 3. When the sheet-aligning action of the first sheet S1 starts, the first driving element 26*a* is controlled by the controller 34 to be rotated in the anti-clockwise direction. Correspondingly, the first transmission element 27*a* is transmitted and rotated in the anti-clockwise direction. As the first transmission element 27*a* is rotated in the clockwise direction, the first alignment arm 21 is continuously moved toward the second alignment arm 22. Due to the width of the second blocking piece 21*e*, the controller 34 does not immediately calculate the moving distance of the first alignment arm 21. Until the first sensor 23 is no longer interrupted by the second end 21*eb* of the second blocking piece 21*e* and the first sensor 23 issues a low-level signal L at the time spot T3 (see FIG. 7), the controller 34 starts to calculate the moving distance of the first alignment arm 21. Until the moving distance of the first alignment arm 21 is equal to a preset distance d, the controller 34 stops driving the first driving element 26*a*, wherein the preset distance d is determined according to the size of the sheet. Consequently, the movement of the first alignment arm 21 is stopped. Under this circumstance, the first alignment arm 21 is located at an alignment position c (see FIG. 6C). During the movement of the first alignment arm 21, the first side of the first sheet S1 is pushed by the first sidewall 21*b* of the first alignment arm 21, and thus the first sheet S1 is moved toward the second sidewall 22*b* of the second alignment arm 22. When the first alignment arm 21 is moved to the alignment position c, the second side of the first sheet S1 is nestled against the second sidewall 22*b* of the second alignment arm 22 and the first side of the first sheet S1 is nestled against the first sidewall 21*b* of the first alignment arm 21.

After the sheet-aligning action of the first sheet S1 is completed, if a second sheet S2 is ready to be aligned, the first alignment arm 21 needs to be removed back to the first standby position b1 and a waiting time is required to introduce the second sheet S2 into the sheet placement tray 4. Under control of the controller 34, the first transmission element 27*a* is transmitted by the first driving element 26*a* to be rotated in the clockwise direction. Please also refer to FIG. 3. As the first transmission element 27*a* is rotated in the clockwise direction, the first alignment arm 21 is moved in the direction distant from the second alignment arm 22. Until the first sensor 23 is interrupted by the second end 21*eb* of the second blocking piece 21*e*, the first sensor 23 issues the high-level signal H. In response to the high-level signal H, the controller 34 stops driving movement of the first alignment arm 21. Since the first sensor 23 is interrupted by the second end 21*eb* of the second blocking piece 21*e* (rather than the first end 21*ea* of the second blocking piece 21*e*) at this moment, as shown in FIG. 6D, the first alignment arm 21 is located at a third standby position b3 (rather than the first standby position b1).

During the sheet-aligning action of the second sheet S2 is performed, the controller 34 will calculate the moving distance of the first alignment arm 21. Similarly, until the first sensor 23 is no longer interrupted by the second end 21*eb* of the second blocking piece 21*e* and the first sensor 23 issues a low-level signal L, the controller 34 starts to calculate the moving distance of the first alignment arm 21. The timing of starting calculating the moving distance is identical to that described above. Moreover, the first alignment arm 21 is also stopped at the alignment position c.

During the sheet-aligning action of the second sheet S2 is performed, the first side of the second sheet S2 is pushed by the first sidewall 21*b* of the first alignment arm 21, and thus the second sheet S2 is moved toward the second sidewall 22*b* of the second alignment arm 22. After the sheet-aligning action of the second sheet S2 is completed, the second side and the first side of the second sheet S2 are nestled against the second sidewall 22*b* of the second alignment arm 22 and the first sidewall 21*b* of the first alignment arm 21, respectively (see FIG. 6E). So the first sheet S1 and the second sheet S2 are aligned with each other.

After the sheet-aligning action of the second sheet S2 is completed, if another sheet is ready to be aligned, the controller 34 will drive the first driving element 26*a* again, so that the first alignment arm 21 is moved to the third standby position b3 and a waiting time is required to introduce the sheet into the sheet placement tray 4.

If no additional sheet is needed to be aligned, a stapling operation is performed by a post-processing device (e.g. a stapler), so that the same parts of the first sheet S1 and the second sheet S2 are combined together. Then, the stapled sheets S1 and S2 are ejected out of the sheet placement tray 4. Then, under control of the controller 34, the first alignment arm 21 and the second alignment arm 22 are moved in the directions distant from each other, so that the stapled sheets S1 and S2 fall down to the outer portion of the office machine. Until the first sensor 23 and the second sensor 24 are respectively interrupted by the first blocking piece 21*d* of the first alignment arm 21 and the third blocking piece 22*d* of the second alignment arm 22 (i.e. the first alignment arm 21 and the second alignment arm 22 are respectively moved back to the first home positional and the second home position a2), the controller 34 will stop moving the first alignment arm 21 and the second alignment arm 22. Meanwhile, the sheet-aligning action of the sheet alignment device 2 is finished.

Figure 8A:
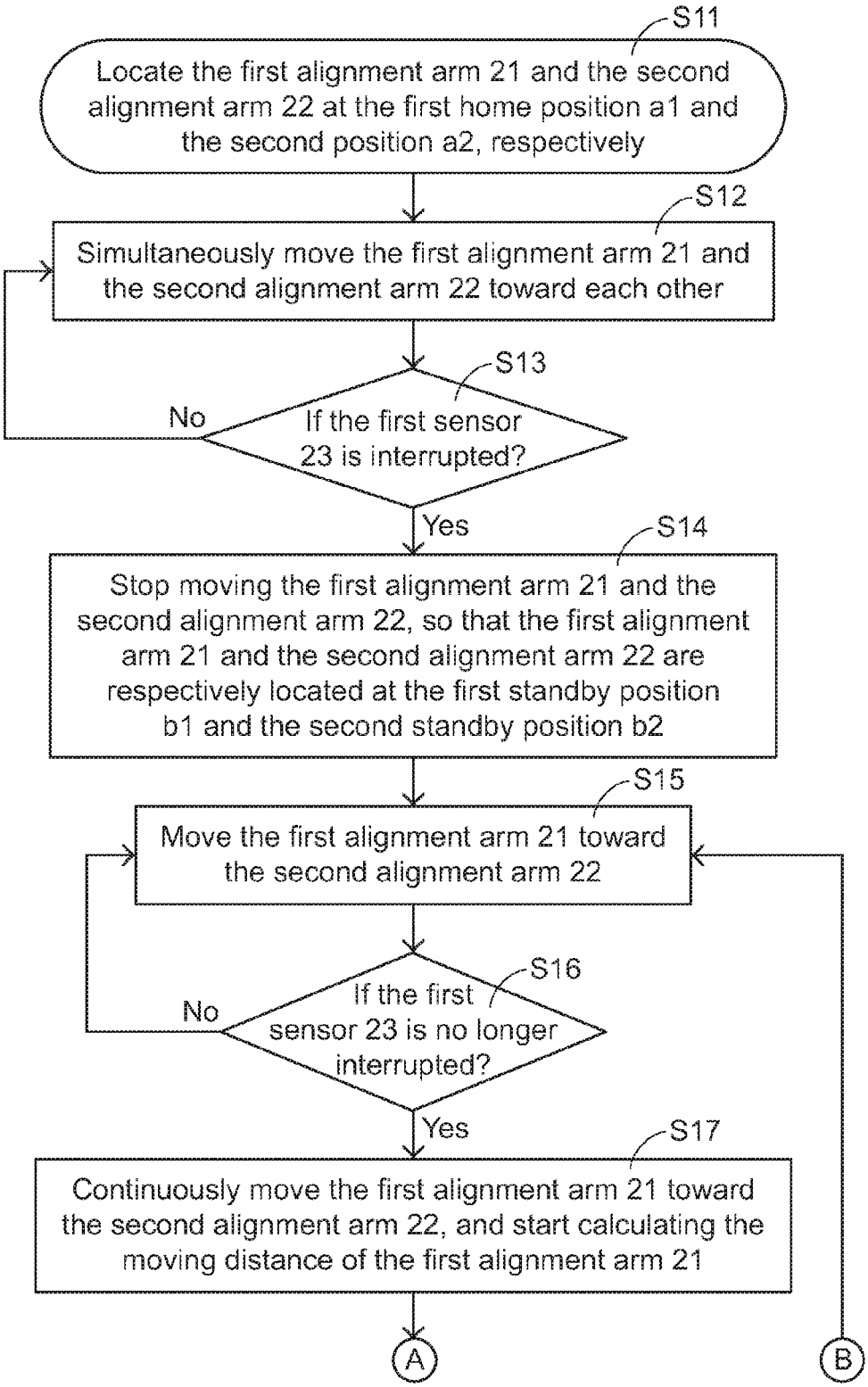
FIG. 8 is a flowchart illustrating the operations of a sheet alignment device according to an embodiment of the present invention.
Figure 8B:
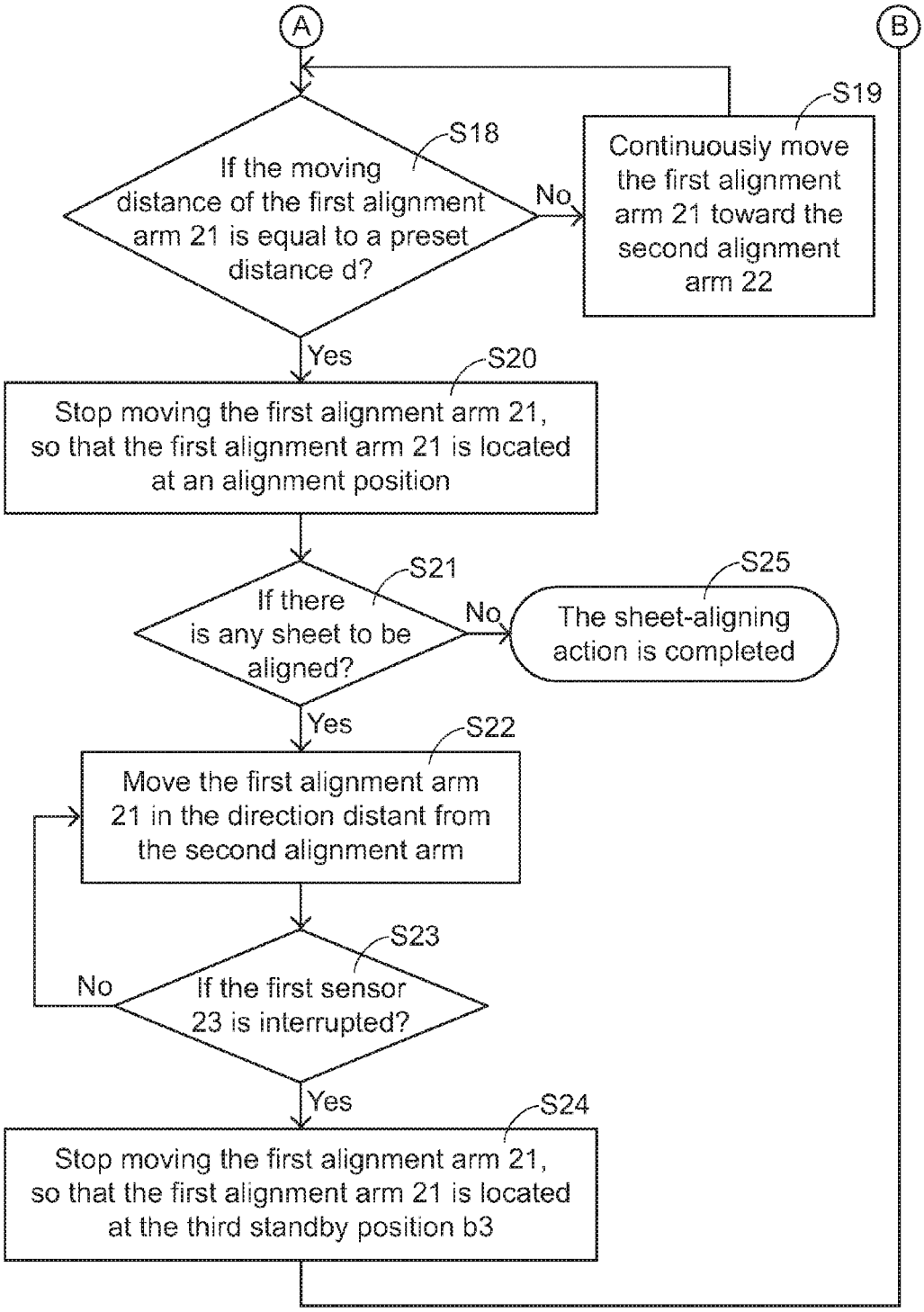

Please refer to FIG. 8. FIG. 8 is a flowchart illustrating the operations of a sheet alignment device according to an embodiment of the present invention. The sheet alignment device 2 performs the sheet-aligning action according to the steps S11 to S25. Firstly, in the step S11, if no sheet is introduced into the sheet placement tray 4, the first alignment arm 21 and the second alignment arm 22 are respectively located at the first home position a1 and the second home position a2. When the sheet is ready to be introduced into the sheet placement tray 4, the first alignment arm 21 and the second alignment arm 22 are simultaneously moved toward each other (in the step S12). After the first alignment arm 21 and the second alignment arm 22 have been moved for a certain time period, the step S13 is performed to judge whether the first sensor 23 is interrupted or not. If the first sensor 23 is not interrupted, the steps S12 and S13 are repeatedly done. Whereas, if the first sensor 23 is interrupted, the step of the step S14 is performed to stop moving the first alignment arm 21 and the second alignment arm 22. Meanwhile, the first alignment arm 21 and the second alignment arm 22 are respectively located at the first standby position b1 and the second standby position b2. When the sheet-aligning action starts, the step S15 is performed to move the first alignment arm 21 toward the second alignment arm 22. Immediately after the movement of the first alignment arm 21 starts, the step S16 is performed to judge whether the first sensor 23 is no longer interrupted. If the judging condition of the Step S16 is not satisfied, the steps S15 and S16 are repeatedly done. If the first sensor 23 is no longer interrupted, the step S17 is performed to continuously move the first alignment arm 21 toward the second alignment arm 22 and start calculating the moving distance of the first alignment arm 21. After the step S17 is done, the step S18 is performed to judge whether the moving distance of the first alignment arm 21 is equal to a preset distance d. If the moving distance of the first alignment arm 21 is not equal to a preset distance d, the first alignment arm 21 is continuously moved and the step S18 is performed again. Whereas, if the moving distance of the first alignment arm 21 is equal to a preset distance d, the step S20 is performed to stop moving the first alignment arm 21. Meanwhile, the first alignment arm 21 is located at the alignment position c. Next, the step S21 is performed to check whether there is any sheet to be aligned. If there is no sheet to be aligned, the sheet-aligning action is completed (in the step S25). If there is any sheet to be aligned, the step S22 is performed to move the first alignment arm 21 in the direction distant from the second alignment arm 22. After the first alignment arm 21 has been moved for a certain time period, the step S23 is performed to judge whether the first sensor 23 is interrupted or not. If the judging condition of the Step S23 is not satisfied, the steps S22 and S23 are repeatedly done. If the first sensor 23 is no longer interrupted, the step S24 is performed to stop moving the first alignment arm 21. Meanwhile, the first alignment arm 21 is located at the third standby position b3. The steps S15 to S21 are repeated done until there in no sheet to be aligned.

From the above description, the second blocking piece 21*e* of the first alignment arm 21 and the first sensor 23 are collectively operated to determine the timing of calculating the moving distance of the first alignment arm 21. During the sheet-aligning action of each sheet is performed, if the first sensor 23 is no longer interrupted by the second end 21*eb* of the second blocking piece 21*e* and the first sensor 23 issues a low-level signal L, the controller 34 starts to calculate the moving distance of the first alignment arm 21. Since the moving distance of the first alignment arm 21 is calculated at the same start point for each sheet during the sheet-aligning action of each sheet is performed, the possibility of resulting in the moving distance error will be minimized. Consequently, the possibility of accumulating the moving distance error will be reduced. Since these sheets can be precisely aligned with each other, after a stapling operation is performed by a post-processing device (i.e. the stapler), the same parts of these sheets can be accurately combined together.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet alignment device for aligning a plurality of sheets on a sheet placement tray with each other, said sheet alignment device comprising:

a first alignment arm for carrying first ends of said sheets, and comprising a first platform, a first sidewall, a first blocking piece and a second blocking piece, wherein said first platform is parallel with said sheet placement tray, said first sidewall is perpendicular to said first platform, and said first blocking piece and said second blocking piece are disposed over said first platform;

a second alignment arm for carrying second ends of said sheets, and comprising a second platform, a second sidewall and a third blocking piece, wherein said second platform is parallel with said sheet placement tray, said second sidewall is perpendicular to said second platform, and said third blocking piece is disposed over said second platform;

a power device and a transmission device, wherein said transmission device is connected with said power device, said first alignment arm and said second alignment arm, wherein through said transmission device, said first alignment arm is driven by said power device to be moved to a first home position, a first standby position and an alignment position, and said second alignment arm is driven by said power device to be moved to a second home position and a second standby position;

a first sensor disposed over said first alignment arm for detecting a position of said first alignment arm;

a second sensor disposed over said second alignment arm for detecting a position of said second alignment arm; and a controller for controlling movement of said first alignment arm and said second alignment arm, wherein if no sheet is placed on said sheet placement tray, said first alignment arm and said second alignment arm are controlled by said controller to be moved to said first home position and said second home position, wherein if said first sensor and said second sensor are respectively interrupted by said first blocking piece and said third blocking piece, said controller stops moving said first alignment arm and said second alignment arm, wherein when a first sheet is introduced into said sheet placement tray, said first alignment arm and said second alignment arm are controlled by said controller to be moved to said first standby position and said second standby position, respectively, wherein when said first sensor is interrupted by said second blocking piece, said controller stops moving said first alignment arm and said second alignment arm.

2. The sheet alignment device according to claim 1 wherein said power device comprises a first driving element and a second driving element, and said transmission device comprises a first transmission element and a second transmission element, wherein said first transmission element is connected with said first driving element and said first alignment arm, and said second transmission element is connected with said second driving element and said second alignment arm.

3. The sheet alignment device according to claim 2 wherein said first alignment arm further comprises a third platform, and said second alignment arm further comprises a fourth platform, wherein said third platform is extended from said first sidewall and parallel with said first platform, and said fourth platform is extended from said second sidewall and parallel with said second platform.

4. The sheet alignment device according to claim 3 further comprising a first roller, a second roller and a first elastic element, wherein said first roller is disposed on said first driving element, said second roller is disposed on said third platform of said first alignment arm, the outer peripheries of said first roller and said second roller are enclosed by said first transmission element, and said first elastic element is disposed on said first transmission element for maintaining a tension force of said first transmission element.

5. The sheet alignment device according to claim 3 further comprising a third roller, a fourth roller and a second elastic element, wherein said third roller is disposed on said second driving element, said fourth roller is disposed on said fourth platform of said second alignment arm, the outer peripheries of said third roller and said fourth roller are enclosed by said second transmission element, and said second elastic element is disposed on said second transmission element for maintaining a tension force of said second transmission element.

6. The sheet alignment device according to claim 3 wherein said first blocking piece and said second blocking piece are disposed on said third platform, and said third blocking piece is disposed on said fourth platform.

7. The sheet alignment device according to claim 3 further comprising a supporting shaft, wherein both ends of said supporting shafts are disposed on said third platform and said fourth platform to be connected with said first alignment arm and said second alignment arm, respectively, wherein said first alignment arm and said second alignment arm are movable toward each other or distant from each other along said supporting shaft.

8. The sheet alignment device according to claim 3 wherein said first alignment arm further comprises a first fixing part, and said second alignment arm further comprises a second fixing part, wherein said first fixing part is disposed on said third platform for fixing said first alignment arm on said first transmission element, and said second fixing part is disposed on said fourth platform for fixing said second alignment arm on said second transmission element.

9. The sheet alignment device according to claim 1 wherein when a sheet-aligning action of said first sheet starts, said first alignment arm is controlled by said controller to be moved to said alignment position according to a size of said first sheet, wherein after said sheet-aligning action of said first sheet is completed, if there is any sheet to be aligned, said first alignment arm is moved to said first standby position, wherein when said first sensor is interrupted by said second blocking piece, said controller stops moving said first alignment arm.

* * * * *